United States Patent [19]

Hunter

[11] 4,073,538

[45] Feb. 14, 1978

[54] ARM STRUCTURE FOR RECLINING SEAT

[76] Inventor: George Taylor Hunter, Rte. 3, Box 250, Howe, Ind. 46764

[21] Appl. No.: 756,171

[22] Filed: Jan. 3, 1977

[51] Int. Cl.[2] ..... A47C 7/54

[52] U.S. Cl. ..... 297/417; 248/242

[58] Field of Search ..... 247/113, 115, 411, 417, 247/416, 433, 78; 248/240, 240.4, 242, 244

[56] References Cited

U.S. PATENT DOCUMENTS

| | | | |
|---|---|---|---|
| 2,257,150 | 9/1941 | Beeson | 297/433 |
| 2,278,749 | 4/1942 | Todd | 297/113 |
| 3,357,740 | 12/1967 | Vaughn et al. | 297/417 X |
| 3,795,379 | 3/1974 | Gray | 248/242 |

*Primary Examiner*—James C. Mitchell
*Attorney, Agent, or Firm*—Marmaduke A. Hobbs

[57] ABSTRACT

An arm structure for a reclining seat such as those used on planes, buses, and train coaches, in which one or both of the arms are adjustable between a substantially horizontal position when the back is in upright position and a horizontal or fully down position when the back of the seat is in a reclined position. A latch mechanism holds the arm in the various positions and is released to move the arm to any one of the positions by pulling the arm forwardly and moving it to a selected position. The arm can be lifted to any one of the positions by merely lifting the arm which snaps successively into the various positions as it is pivotally raised. The latch mechanism holds the arm rigidly in position with respect to any pressure applied downwardly thereon by the arm of the occupant of the seat. The arm rest may have one of a number of different types of upholstery or covering to match the covering on the seat.

8 Claims, 10 Drawing Figures

ARM STRUCTURE FOR RECLINING SEAT

Most seats on commercial passenger aircraft, interstate buses and passenger train coaches are of the reclining type having two arm rests. In this type of seat, the seat portion is usually stationary and rigidly supported on a pedestal, base, or other firm support, and the back of the seat is pivoted to the rear of the seat portion and is normally adjustable to a number of angular positions from almost vertical position to a substantially reclining position. On the conventional type seats, the arm rests are mounted on and connected directly to the seat portion by a rigid structure which holds the arm rests in a single fixed position regardless of the position of the back. This often places the occupant in an uncomfortable position in the seat, with little or no support for the occupant's arms by the arm rest when the back is in a reclined position. This difficulty has been partially alleviated in the past by attaching the arm rests directly to the back so that they move back when the back is moved to a reclining position; however, with the arm rests rigidly attached, they do not remain in a generally horizontal position, but rather follow an angular movement as the seat back is adjusted. Consequently, the arm rests are frequently in a position which interferes with a person entering or leaving the seat, and provide little comfort for the occupant when the seat is in a substantially reclined position. It is therefore one of the principal objects of the present invention to provide an arm structure for a reclining seat, which can be readily adjusted to various angular positions with respect to the reclining back, and which can be adjusted to a generally horizontal position when the back of the seat is in its fully upright position or in a substantially reclining position.

Another object of the invention is to provide an arm structure for reclining seats, which will give firm, comfortable support to the occupant's arms in normally adjusted position of the seat back, and which will fold down along the side of the back so that the arm rest will not interfere with the occupant.

Still another object of the invention is to provide an arm rest structure of the aforementioned type, which is simple in construction and operation, and which can be easily adjusted between various angular positions by the occupant without his leaving the seat, and which is so constructed and designed that it is adaptable to either the right or left side of the seat.

Further objects and advantages of the present invention will become apparent from the following description and accompanying drawings, wherein.

Figure 1:
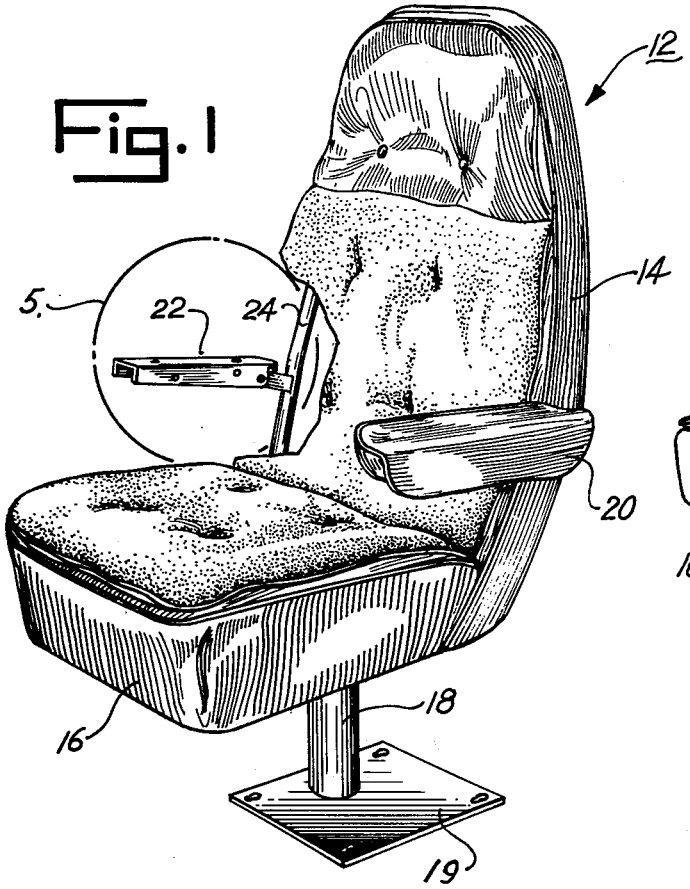
FIG. 1 is a perspective view of a seat, such as that used on aircraft, with a portion broken away to illustrate the arm construction.
Figure 2:
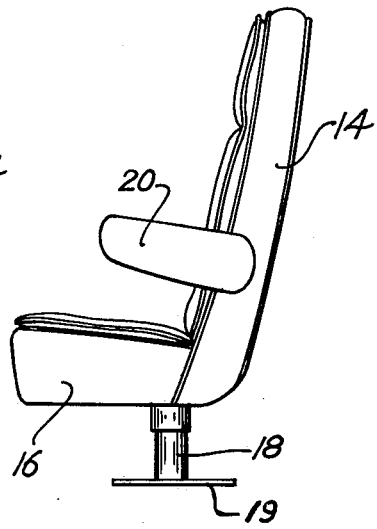
FIG. 2 is a side elevation of the seat shown in FIG. 1, illustrating the back in its upright position.
Figure 3:
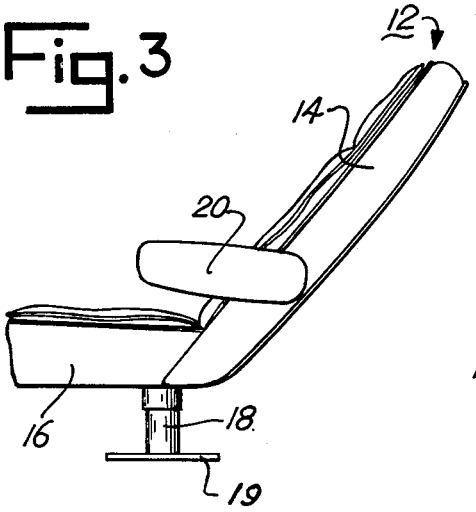
FIG. 3 is a side elevational view of the seat shown in FIGS. 1 and 2, with the back in a substantially reclined position and the arms adjusted to a horizontal position.
Figure 4:
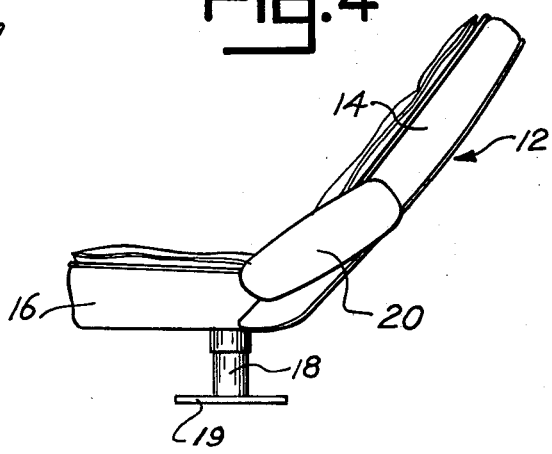
FIG. 4 is a side elevational view of the seat shown in the preceding figures, with the back substantially reclined and the arms in their lowered position.
Figure 5:
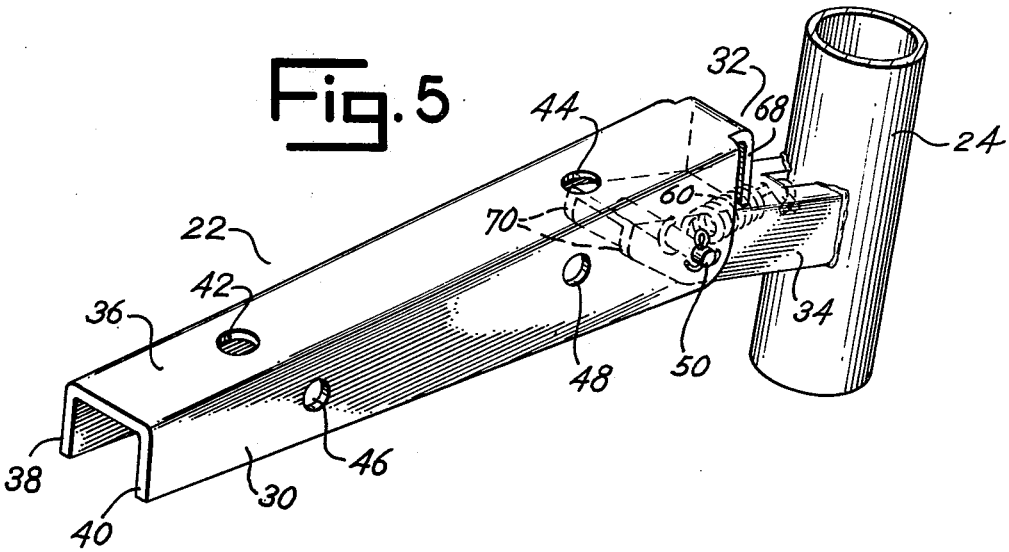
FIG. 5 is a perspective view of the arm structure of the seat shown in the preceding figures.
Figure 6:
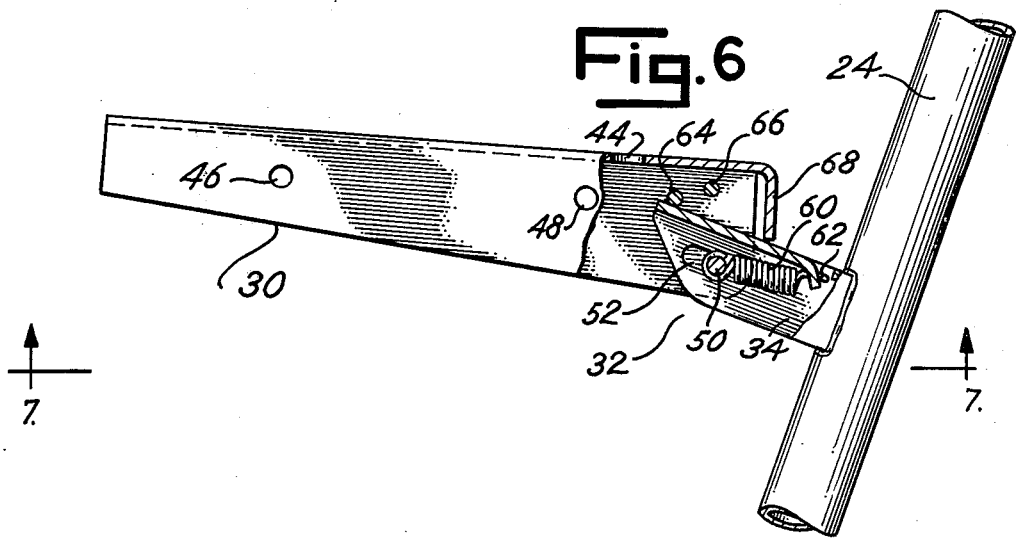
FIG. 6 is a side elevational view of the arm structure shown in FIG. 5, with a portion broken away to show the operating mechanism.
Figure 7:
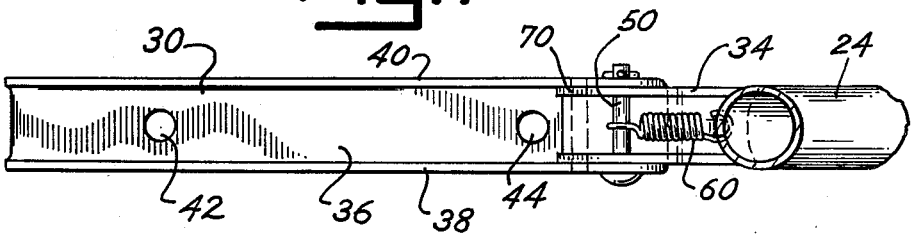
FIG. 7 is a bottom plan view of the arm structure shown in FIG. 6.
Figure 8:
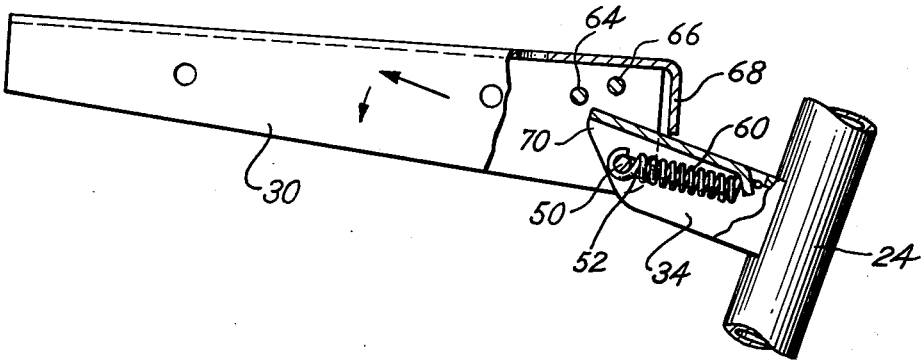
FIGS. 8, 9 and 10 are side elevational and partial cross sectional views of the arm structure showing the manner in which the arm is moved from its upper, horizontal position to its fully lowered position.

Referring more specifically to the drawings, and to FIG. 1 in particular, numeral 12 designates generally a seat such as that used on a plane or bus, the seat including a back 14, a seat portion 16, and pedestal 18, and a base 19 for attaching the seat rigidly to the floor or other supporting structure. Attached to the back 14 are pivoted arms 20 and 22, shown in their raised position for supporting the arms of the occupant of the seat when the back is in its substantially vertical or upright position. The principal part of the invention involves the structure in which the arms are pivotally adjustable between several positions so that they may be placed in horizontal position both while the seat is in its upright position, as shown in FIGS. 1 and 2, and in its substantially reclined position, as seen in FIG. 3. The arms may be moved from the position shown in FIGS. 1 and 2 to the position shown in FIG. 3, and thence to the position shown in FIG. 4. The remaining structure of the seat or chair may be of any number of different types, including those used on planes, buses, trains, in theaters, and in lounges and homes if desired. The seat shown in the drawings has upright tubular frame members 24 on each side of the back, to which the arm structure is attached, and while the frame shown is commonly used for seats and chairs, other types of frames may be used on which my arm structure is mounted.

The arm structure 22 includes an arm rest 30 supported by an operating mechanism indicated generally by numeral 32 and being attached by a lug 34 to seat frame member 24. The arm rest shown in the drawings consists of an inverted U-shaped or channel-like metal section having the longitudinal center portion 36 forming the top of the arm rest frame, and the two downwardly extending portions forming sides 38 and 40 of the arm rest. Holes 42 and 44 in the top, and 46 and 48 in the opposite sides, are provided for attaching the upholstery, padding, or some other outer layer or structure of the arm rest. Lug 34 is welded or otherwise rigidly joined to frame member 24 and is attached to arm rest 30 by a pin 50 secured in the two sides 38 and 40 and extending through a slot 52 in the outer end of lug 34. The slot 52 permits pin 50, and consequently arm rest 30, to move longitudinally forwardly and rearwardly with respect to lug 34, and a coil spring 60 attached to pin 50 and to a rigid metal anchor member 62 on lug 34 constantly urges pin 50 and arm 30 rearwardly, i.e. toward frame 24.

The arm rest 30 is held in its two upper positions by pins 64 and 66 extending parallel to pin 50 and being secured in holes in the two sides 38 and 40. With pin 50 in the rear end of slot 52, pin 64 engages the upper side of lug 34 and prevents the arm rest from moving downwardly. A downwardly extending member 68 attached to and preferably forming an integral part of upper side 36 of arm rest 30 extends downwardly and forms a stop for the upper position of the arm rest. Thus, when pin 50 is in the rear end of slot 52, the arm is held rigidly in place by pin 64 and the end of member 68. Pin 66 retains arm rest 30 in a partially lowered position, the movement between pins 64 and 66 being achieved by pulling arm rest 30 forwardly, thereby moving pin 50 forwardly in slot 52, and thus disengaging pin 64 from the upper surface of lug 34 and permitting the pin to bypass the forward end 70 of lug 34. Further movement downwardly engages pin 66 with the upper surface of lug 34 as spring 60 retracts pin 50 and arm 30 rearwardly, thus holding the arm rest in a second rigid position. Movement of the arm forwardly also disengages pin 66 from the upper surface of lug 34 and permits the arm to move to its fully lowered position where member 68 engages the upper side of lug 34 and retains the arm in a position substantially parallel with back 14. The arm rest can be placed in either the intermediate or upper positions by pulling the arm rest upwardly to cause pins 64 and 66 to pass over the forward end of lug 34 to either the intermediate or upper arm position. The mechanism for the left hand arm is the same as that shown and described for the right hand arm, the two arms being adapted for either side without change.

Figure 9:
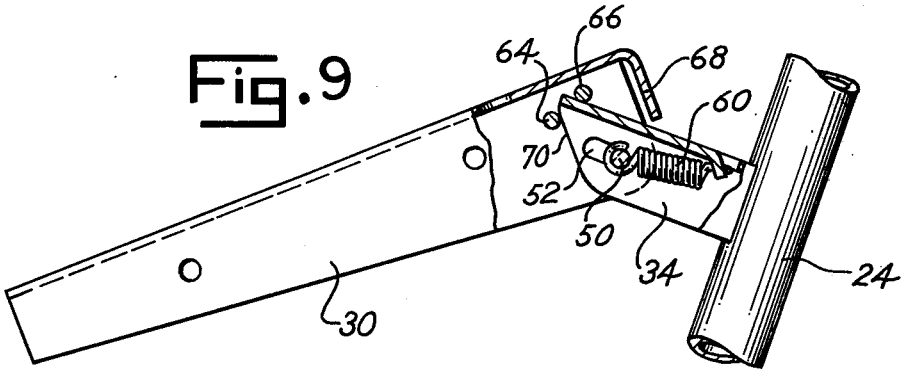
Figure 10:
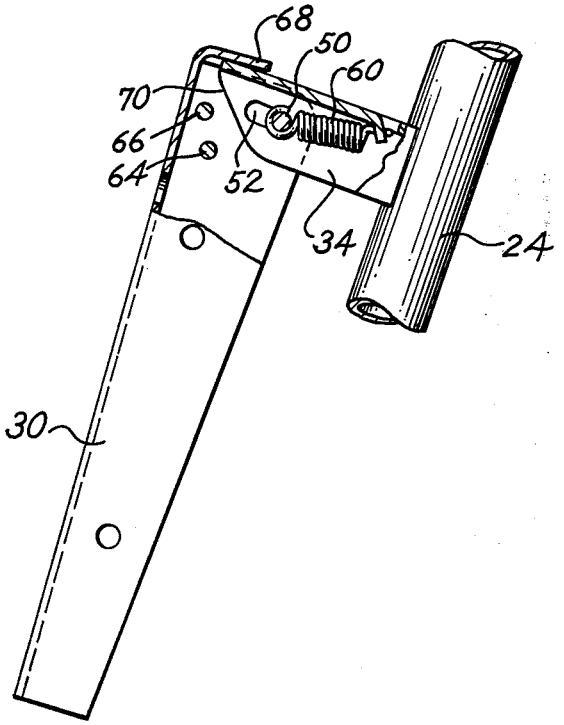

In the operation and use of my arm structure for the reclining seat, with the back in the position illustrated in FIG. 1, arm rest 30 extends generally outwardly from lug 34, and pin 64 rests on the upper side of the lug when the arm rest is held in its retracted position by spring 60 reacting between pin 50 and anchor 62. Thus the arm rest is held in substantially horizontal position as shown in FIGS. 1 and 2. When the back is reclined to the position shown in FIG. 3, the arm rest can be placed in horizontal position by pulling the arm rest forwardly until pin 64 will pass downwardly over the forward end 70 of lug 34. When the pin has passed the upper part of the end, releasing the arm permits the arm rest to be retracted to the point where pin 66 engages the upper side of lug 34, thus holding the arm in its intermediate position illustrated in FIG. 9.

When the arm rest is to be positioned in the place illustrated in FIG. 4, the rest is again pulled forward and pushed downwardly, thus causing pin 66 to pass the forward end of the lug. Further movement of the arm downwardly causes member 68 to engage the upper side of the lug and hold the arm in a downwardly fixed position. The arm can be returned to either of the two elevated positions by lifting the arm, causing the pin 64 to engage the forward end of the lug and slip upwardly to either of the two positions where one or the other of the two pins 64 or 66 again engages the upper surface of lug 34 after the arm rest has been retracted by the spring. In the upward movement of the arm, it is not necessary to pull the arm forwardly, since the forward end 70 of the lug acts as a cam when engaged by either of the two pins, thus causing the arm to move forwardly sufficiently to permit the pins to pass the forward end of the lug. In all three positions the arm is held against further downward movement so that the arm of the occupant will be firmly supported by the arm rest.

It is seen that the present arm structure can be readily adjusted to various angles relative to the back of the seat, to position the arm rest in horizontal position or in a position in which it does not interfere with the movement of the occupant of the seat. While only two positioning pins 64 and 66 have been shown, one or more additional pins may be included in the structure if additional positions of the arm rest are desired. The additional pins will operate in essentially the same way as pins 64 and 66 to hold the arm in elevated positions. The shape of the arm rest may be changed to accommodate different types of upholstery and covering for the rest, to adapt it to various types and designs of seats and coverings thereon. The arm structure is readily adaptable to various types of seats, including conventional living room and office chairs, as well as plane, train and bus seats.

While only one embodiment of the present arm structure for reclining seats has been described in detail herein, various changes and modifications may be made without departing from the scope of the invention.

I claim:

1. An arm structure for a reclining seat having a back pivoting from a substantially vertical position to a reclining position, comprising a member for attachment to a lateral side of the back and extending forwardly therefrom, an arm rest pivotally connected to said member, a latch means for retaining said arm rest selectively in at least two angular positions with respect to said back, and means in said latch means operable by a forward movement of said arm rest for releasing said arm rest for angular movement, including a lug extending longitudinally with respect to said arm rest and a pair of arm positioning pins positioned transversely with respect to said arm rest for engagement with said lug to retain said arm rest in selected positions.

2. An arm structure for a reclining seat as defined in claim 1 in which a longitudinal slot on a horizontal axis extends transversely through said lug and a pin secured to said arm rest extends through said longitudinal slot.

3. An arm structure for a reclining seat as defined in claim 2 in which a spring is attached at one end to said last mentioned pin and anchored at the other end to said lug for urging said last mentioned pin and said arm rest rearwardly to a position where one of said arm positioning pins engages said lug.

4. An arm structure for a reclining seat as defined in claim 3 in which said arm rest is of a generally inverted U-shaped, transverse cross sectional configuration having opposed sides, and said arm positioning pins are secured rigidly to said sides.

5. An arm structure for a reclining seat as defined in claim 4 in which said arm rest has an upper surface connecting said two sides, and a member is attached to the rear end of said arm rest for engaging said lug for determining the upper and lower limits of movement of said arm rest.

6. An arm structure for a reclining seat as defined in claim 5 in which said arm positioning pins pass downwardly beyond the forward end of said lug when said arm is moved to the forward latch-releasing position, and said lug includes a cam surface in the forward end thereof on which said pins traverse to pass upwardly over the forward end of said lug when said arm is raised.

7. An arm structure for a reclining seat as defined in claim 6 in which means rigidly secures said lug to the back of the seat.

8. An arm structure for a reclining seat as defined in claim 1 in which an arm positioning stop means is attached to the rear end of said arm rest and engages said lug when said arm rest is in either its fully raised or its fully lowered position.

* * * * *